US008893703B2

(12) United States Patent
DeFoort et al.

(10) Patent No.: US 8,893,703 B2
(45) Date of Patent: Nov. 25, 2014

(54) COMBUSTION CHAMBER FOR CHARCOAL STOVE

(75) Inventors: Morgan W. DeFoort, Fort Collins, CO (US); Cory Kreutzer, Loveland, CO (US); Sean Babbs, Fort Collins, CO (US); Josh Agenbroad, Old Snowmass, CO (US); Christian L'Orange, Fort Collins, CO (US)

(73) Assignee: Colorado State University Research Foundation, Fort Collins, CO (US)

( * ) Notice: Subject to any disclaimer, the term of this patent is extended or adjusted under 35 U.S.C. 154(b) by 611 days.

(21) Appl. No.: 12/947,680

(22) Filed: Nov. 16, 2010

(65) Prior Publication Data

US 2011/0114074 A1 May 19, 2011

Related U.S. Application Data

(60) Provisional application No. 61/261,694, filed on Nov. 16, 2009.

(51) Int. Cl.
*F24C 1/16* (2006.01)
*F24B 1/20* (2006.01)

(52) U.S. Cl.
CPC ..... *F24B 1/202* (2013.01)
USPC ..... 126/9 R; 126/25 R; 126/29; 126/9 B; 126/285 R; 126/59

(58) Field of Classification Search
CPC ..... F23B 10/00; F23B 20/00; A47J 27/002; A47J 27/12; A47J 27/122; A47J 27/13; A47J 37/0763; F24B 1/026; F24B 1/028; F24B 13/02
USPC ..... 126/25 R, 29, 9 R, 9 B, 242, 243, 245, 126/285 R, 290, 59
See application file for complete search history.

(56) References Cited

U.S. PATENT DOCUMENTS 103,736 A * 5/1870 Gregory ..... 126/25 R
1,419,600 A * 6/1922 Anderson ..... 126/58

(Continued)

FOREIGN PATENT DOCUMENTS

GB 2371473 7/2002
JP 2002115848 A * 4/2002 ..... F24B 1/18

(Continued)

OTHER PUBLICATIONS

International Search Report and Written Opinion, dated Feb. 1, 2011, Application No. PCT/US2010/056790, 9 pages.

(Continued)

*Primary Examiner* — Jorge Pereiro
(74) *Attorney, Agent, or Firm* — Dorsey & Whitney LLP

(57) ABSTRACT

A combustion chamber may include an upper and a lower chamber. The chambers may be separable to aid in loading fuel and removing spent fuel. The cross-section of the upper combustion chamber may be less than the cross-section of the lower section. Charcoal or other biomass fuel may be added into the lower combustion chamber and may be supported by a grate. Oxygen may be fed into the combustion chamber through a plurality of apertures that may be substantially shielded from direct line of site of the fuel bed. The upper combustion chamber may further include an annular constriction, to aid in constricting the view factor between the cooking vessel and the fuel bed. The constriction may also aid in radiating energy back to the fuel bed.

16 Claims, 9 Drawing Sheets

(56) References Cited

U.S. PATENT DOCUMENTS

| | | | | | |
|---|---|---|---|---|---|
| 1,512,482 | A | * | 10/1924 | Patterson | 219/400 |
| 1,725,974 | A | | 8/1929 | Brautigam et al. | |
| 1,968,088 | A | | 7/1934 | Mekler | |
| 2,383,188 | A | | 8/1945 | Griswold | |
| 2,565,677 | A | | 8/1951 | Pollard | |
| 2,786,463 | A | * | 3/1957 | Vincent | 126/25 C |
| 3,126,881 | A | * | 3/1964 | Blotsky, Jr. | 126/25 C |
| D214,297 | S | | 5/1969 | Ihde | |
| 3,765,397 | A | * | 10/1973 | Henderson | 126/25 R |
| D229,277 | S | | 11/1973 | Ming-Kong | |
| 3,851,639 | A | * | 12/1974 | Beddoe | 126/25 R |
| 4,034,142 | A | | 7/1977 | Hecht | |
| 4,037,580 | A | * | 7/1977 | Angelo | 126/25 R |
| 4,167,207 | A | | 9/1979 | Rao et al. | |
| 4,206,598 | A | | 6/1980 | Rao et al. | |
| 4,257,391 | A | | 3/1981 | Carin | |
| 4,291,669 | A | | 9/1981 | Herne, Jr. | |
| 4,351,316 | A | | 9/1982 | Kroll | |
| 4,471,751 | A | | 9/1984 | Hottenroth et al. | |
| 4,471,985 | A | * | 9/1984 | Mahoney | 294/10 |
| 4,473,059 | A | | 9/1984 | Nason | |
| 4,480,436 | A | | 11/1984 | Maclin | |
| 4,502,464 | A | * | 3/1985 | Figueroa | 126/163 R |
| 4,512,249 | A | * | 4/1985 | Mentzel | 99/352 |
| 4,587,947 | A | * | 5/1986 | Tomita | 126/25 R |
| 4,714,659 | A | | 12/1987 | Lindgren et al. | |
| 4,732,138 | A | * | 3/1988 | Vos | 126/25 A |
| 4,875,462 | A | * | 10/1989 | Armstrong et al. | 126/29 |
| 4,924,845 | A | * | 5/1990 | Johnson et al. | 126/25 R |
| 4,962,696 | A | * | 10/1990 | Gillis | 99/340 |
| 5,002,037 | A | * | 3/1991 | Armstrong et al. | 126/29 |
| 5,024,208 | A | * | 6/1991 | Hottenroth et al. | 126/25 R |
| 5,144,939 | A | * | 9/1992 | Christopherson | 126/25 R |
| 5,236,787 | A | | 8/1993 | Grassi | |
| 5,267,609 | A | | 12/1993 | Olsson | |
| 5,480,608 | A | | 1/1996 | Tsuda et al. | |
| 5,881,709 | A | | 3/1999 | Daoust | |
| 5,909,729 | A | * | 6/1999 | Nowicke, Jr. | 126/25 R |
| 5,958,603 | A | | 9/1999 | Ragland et al. | |
| 6,012,493 | A | | 1/2000 | Remke et al. | |
| 6,016,797 | A | * | 1/2000 | Nowicke, Jr. | 126/25 R |
| 6,231,807 | B1 | | 5/2001 | Berglund | |
| 6,314,955 | B1 | * | 11/2001 | Boetcker | 126/9 R |
| 6,470,875 | B2 | * | 10/2002 | Liu | 126/25 R |
| 6,615,821 | B1 | * | 9/2003 | Fisenko | 126/25 R |
| 6,651,645 | B1 | * | 11/2003 | Nunez Suarez | 126/9 R |
| 6,799,632 | B2 | | 10/2004 | Hall et al. | |
| D512,264 | S | | 12/2005 | May et al. | |
| 7,167,642 | B1 | | 1/2007 | Wagner | |
| 7,469,489 | B2 | | 12/2008 | Lewin | |
| D640,497 | S | | 6/2011 | Lorenz et al. | |
| 8,025,984 | B2 | * | 9/2011 | Stamm | 428/678 |
| 2003/0234014 | A1 | * | 12/2003 | Fitzgerald | 126/25 R |
| 2004/0020659 | A1 | | 2/2004 | Hall et al. | |
| 2005/0229916 | A1 | * | 10/2005 | Fitzgerald | 126/25 R |
| 2007/0042304 | A1 | | 2/2007 | Lewin | |
| 2009/0025703 | A1 | | 1/2009 | Van Der Sluis et al. | |
| 2009/0165769 | A1 | | 7/2009 | Van Der Sluis | |
| 2010/0083946 | A1 | | 4/2010 | Cedar et al. | |
| 2010/0258104 | A1 | * | 10/2010 | DeFoort et al. | 126/15 R |

FOREIGN PATENT DOCUMENTS

| | | | | |
|---|---|---|---|---|
| WO | 2006132556 | | 12/2006 | |
| WO | WO 2009070952 | A1 * | 6/2009 | A47J 36/26 |

OTHER PUBLICATIONS

International Search Report and Written Opinion dated Jun. 15, 2010, Application No. PCT/US2010/030514, 9 pages.

* cited by examiner

COMBUSTION CHAMBER FOR CHARCOAL STOVE

CROSS REFERENCE TO RELATED APPLICATIONS

The present application claims benefit of priority under 35 U.S.C. §119(e) to U.S. Provisional Application No. 61/261,694, filed Nov. 16, 2009. This application is related to U.S. provisional application No. 61/168,538, titled Cook Stove Assembly, filed on Apr. 10, 2009, and which is hereby incorporated by reference.

BACKGROUND OF THE INVENTION

The present invention relates generally to stoves and cooking apparatus for use in confined areas.

About half of the world's population cooks over a biomass fire. Use of biomass as an energy source has lead to deforestation as well as a decrease in indoor air quality. In Africa, this biomass fuel source is typically charcoal.

Charcoal stoves may burn relatively smoke free (i.e. low production of particulate matter), however they tend to produce high levels of carbon monoxide (CO). This may be caused by inefficient or incomplete combustion of charcoal fuel. While production of CO may not pose a significant problem when cooking in open spaces, such as out of doors, when charcoal combustion takes place within a living space or other enclosed space, carbon monoxide may build-up causing sickness or death.

Carbon monoxide is a colorless, odorless, tasteless toxic gas produced by incomplete combustion in fuel-burning. CO poisoning may result in headaches, nausea, dizziness, or confusion. Left undetected, CO exposure can be fatal, and in the United States alone, accidental CO poisoning results in about 15,000 ER visits a year.

Because carbon monoxide is a byproduct of incomplete combustion, procedures that enhance combustion will reduce the production of carbon monoxide. Those of skill in the art will understand that enhancing combustion may generally be accomplished in at least three ways—by increasing the duration of combustion, raising the temperature at which combustion takes place, or optimizing the mixing of oxygen and fuel.

In some cases, maximizing one factor may lead to minimization of a second factor. For example, optimizing the mixing of oxygen often requires maximizing airflow, but this may also lead to a decrease in combustion temperature as cooler ambient air enters the combustion area. Thus, enhancement of combustion often requires a balancing of these factors.

It is easier to control the factors that enhance combustion when the fuel source is gaseous rather than solid. Developed countries have largely replaced solid fuel with gaseous fuels for cooking and heating. But, as is evident from the CO poisoning statistics presented above, the use of gaseous fuels alone will not prevent CO poisoning when fuels are burned indoors.

Modern appliances are often controlled by sophisticated electronics, and combustion products are normally vented directly out of the living space to help reduce CO production and/or buildup. In contrast, in developing countries where charcoal combustion may take place on simple cookstoves, within the living space, and with little or no dedicated ventilation, stoves should be engineered to balance efficiency and CO production.

Reducing CO emission may require both a reduction in the production of CO as well as combustion of any CO that is produced.

Fuel burn rate, airflow rate, and operating temperature are some of the most important and basic characteristics of a stove. Charcoal stoves generally operate at higher temperatures than other biomass stoves. The top of a charcoal fuel bed may be about 1000° K [~730° C.]. CO oxidation is affected by combustion temperature, residency time, and oxygen concentration.

In many rural and developing communities, especially in Africa and Asia, charcoal is a major energy source. Charcoal is made by partially cooking biomass, such as wood, in a low oxygen environment. This process, often referred to as pyrolysis, reduces the water and volatile content of the biomass rendering it mostly carbon. Charcoal burns at very high temperatures. In some cases, charcoal may burn at or about 1100° C.

Even before charcoal is used as an energy source, production of charcoal contributes to deforestation and increases greenhouse gases (both from direct production of charcoal and as an indirect result of loss of trees). Thus an increase in the efficiency of charcoal stoves may decrease the need for charcoal with an accompanying decrease in deforestation and greenhouse gases.

Existing charcoal stove designs, for the most part, rely on traditional materials such as brick, stone, or ceramics, while some stoves may also be constructed of metal. Mass produced ceramic stoves may have increased efficiency over traditional charcoal stove designs, but ceramic stoves tend to have high production and distribution costs due to the time needed to construct them (e.g. casting, drying, and firing) and their weight. Metal stoves may be lighter weight and rapidly constructed, but metal stoves are usually less-efficient than ceramic stoves due to quenching of the combustion temperature. In addition, some metal combustion chambers may be more susceptible to corrosion.

Many manufactured stoves, designed for use with solid biomass fuels, are not specifically designed to lessen production of dangerous combustion products. Those manufactured stoves that do address indoor pollution are generally not ideal, either because they rely on drastic changes in traditional behavior (such as limiting use of solid fuels, moving the stoves out of doors, or depending on expensive or impractical venting), or they are financially out of reach for the poor. A cooking/heating alternative that is compatible with traditional behavior, inexpensive, and capable of lessening production of dangerous gases, may help prevent death and disease especially among persons of limited income.

One example of a mass produced charcoal stove is the Jiko stove. Over one million Kenyan Ceramic Jiko (KCJ) stoves have been distributed in Kenya and East African nations. The Jiko stove, designed by Kenya Energy and Environment Organizations (KENGO), is ceramic and therefore difficult to manufacture and expensive to distribute. Moreover, while the Jiko stove has demonstrated a near doubling of thermal efficiency as compared to other typical African stoves, use of the Jiko stove results in little to no reduction in harmful emissions.

What is needed is a charcoal stove that lessens CO production while being efficient, inexpensive, and corrosion-resistant. A metal stove with these qualities may be inexpensively manufactured and distributed in rural and developing countries.

BRIEF SUMMARY OF THE INVENTION

The stove described and claimed herein may help decrease the amount of at least carbon monoxide produced during combustion of biomass, for example charcoal.

The present disclosure describes a metal biomass stove that may lower production costs while increasing durability and reducing its fuel consumption and CO emission. The stove combustion chamber may be designed to reduce the amount of, at least, carbon monoxide gas emitted from burning a solid fuel energy source by increasing the combustion temperature of the stove. This increase in combustion temperature may be achieved by increasing air flow, decreasing waste energy lost to thermal mass and unproductive radiative heat transfer.

FIG. 1 is a graphical comparison modeling CO oxidation at varying temperatures provided by various stove designs. This graph shows that the increased combustion temperature provided by the current stove design may dramatically increase CO destruction in biomass stoves. This temperature dependence may lead to a "CO spike" during startup of a stove, which is when CO is being produced from combustion but temperatures are well below the temperatures that may lead to CO oxidation. In this graph at 1100° K [~830° C.] oxidation of CO is nearly complete after 0.1 seconds. In comparison, at 802° K [~530° C.], about 95% of the CO is still present after 3.0 seconds. Thus the stove currently described and claimed may aid in the rapid destruction or oxidation of CO as compared to other stove designs.

In comparison to currently available charcoal burning stoves, the present stove embodiment may provide a 20% reduction in time required to bring water to boil. The present stove is designed to use solid biomass, for example charcoal, as fuel. In addition to an increased efficiency as demonstrated by the decreased boil time, the present stove design may also reduce carbon monoxide emission by 80-95% (measured from a cold-start). This reduction brings the emissions to a level comparable to a typical improved wood burning cook stove.

The combustion chamber may have two parts, a first, lower combustion chamber and a second, upper combustion chamber. The lower combustion chambers may take any of a variety of shapes such as a cylinder, sphere, box, etc. The upper combustion chamber may also define a cylinder, but may also take a variety of different shapes including a square, oval, or funnel shape. The upper combustion chamber may be generally of a smaller radius or maximum cross-sectional dimension than the lower combustion chamber.

The upper section may be separable from the lower section to aid in loading fuel into the combustion chamber and removing spent fuel after use. The upper section or both sections may include handles to aid in transporting and separating the sections. The handles may be attached to the sections or integral parts of the sections.

A grate or grill may be positioned within the lower combustion chamber to receive solid fuel. Solid fuel may be positioned, ignited, and partially or fully consumed within the lower combustion chamber. Flames and gases may be further consumed within the upper part and the resulting heat and exhaust gases directed out of the upper combustion chamber and toward a cooking vessel. The inventive combustion chamber design may contain an annular constriction positioned within the upper combustion chamber. The annular constriction decreases the internal radius/cross-section of the upper combustion chamber either by moving the walls radially inward, or by adding a ring or plate to the upper combustion chamber that decreases the radius.

The constriction may also aid in radiating energy back to the fuel bed thus increasing the fuel bed temperature. The shape of the lower combustion chamber and the transition between the different radii of the upper and lower combustion chambers may also help in radiating energy back to the fuel bed. Thus, the stove constriction described and claimed herein in part may help to reduce the view factor from the fuel bed to the underside of the cooking vessel.

Constricting the radius of the upper combustion chamber may further help redirect partially combusted or uncombusted gases away from the wall of the upper combustion chamber, back toward the center and into the flame where it may be consumed. The constriction may also create turbulence within the upper combustion chamber to aid in mixing gases.

The stove described and claimed herein may also include air flow apertures that may be designed or shielded to prevent radiative energy loss. The apertures allow oxygen into the combustion chamber but are substantially out of the direct line of sight of the fuel bed and thus may prevent the loss of as much as 5% of the energy in the combustion chamber. The flow of oxygen may be regulated during use by a handle attached to an air flow regulator disk positioned above or adjacent to a plurality of inlets at the bottom of the stove.

The stove described and claimed herein may also include insulation under the grate and behind the walls of the combustion chamber to further reduce energy loss.

The stove described and claimed herein may help reduce carbon monoxide production by about 90% over other manufactured ceramic charcoal stoves. This may lead to healthier indoor environments and prevent sickness and even death. Moreover the present stove may increase fuel efficiency thus reducing the amount of deforestation and greenhouse gas production required to produce charcoal.

BRIEF DESCRIPTION OF THE DRAWINGS

FIG. 5A is a section view of the stove of FIG. 2 taken along the plane on which FIG. 2 is shown.

DETAILED DESCRIPTION OF THE INVENTION

Figure 1:
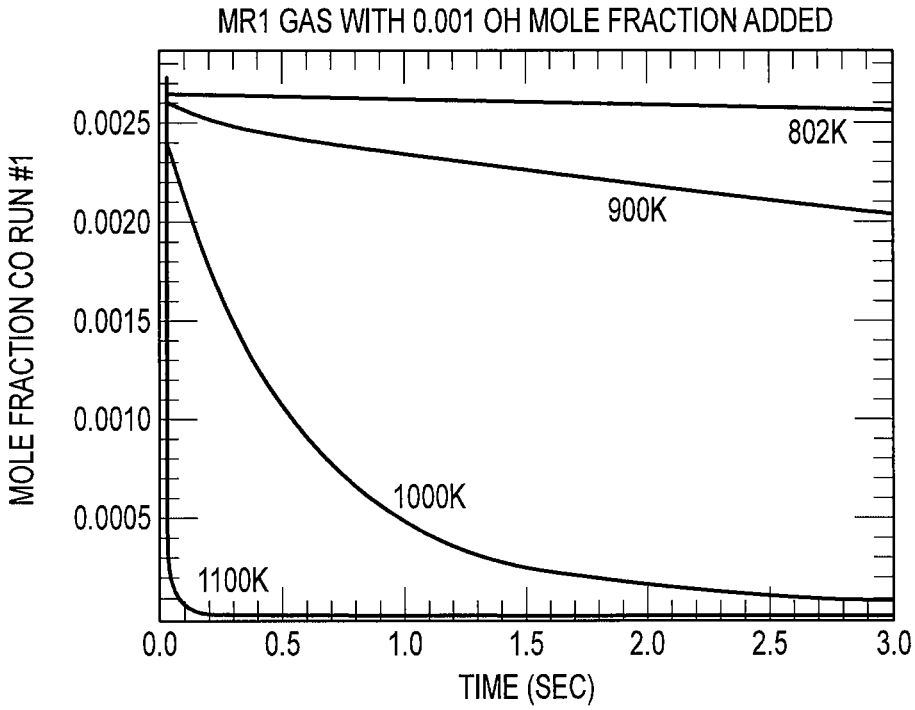
FIG. 1 is a graphical comparison of carbon monoxide oxidation at varying temperatures.
Figure 2:
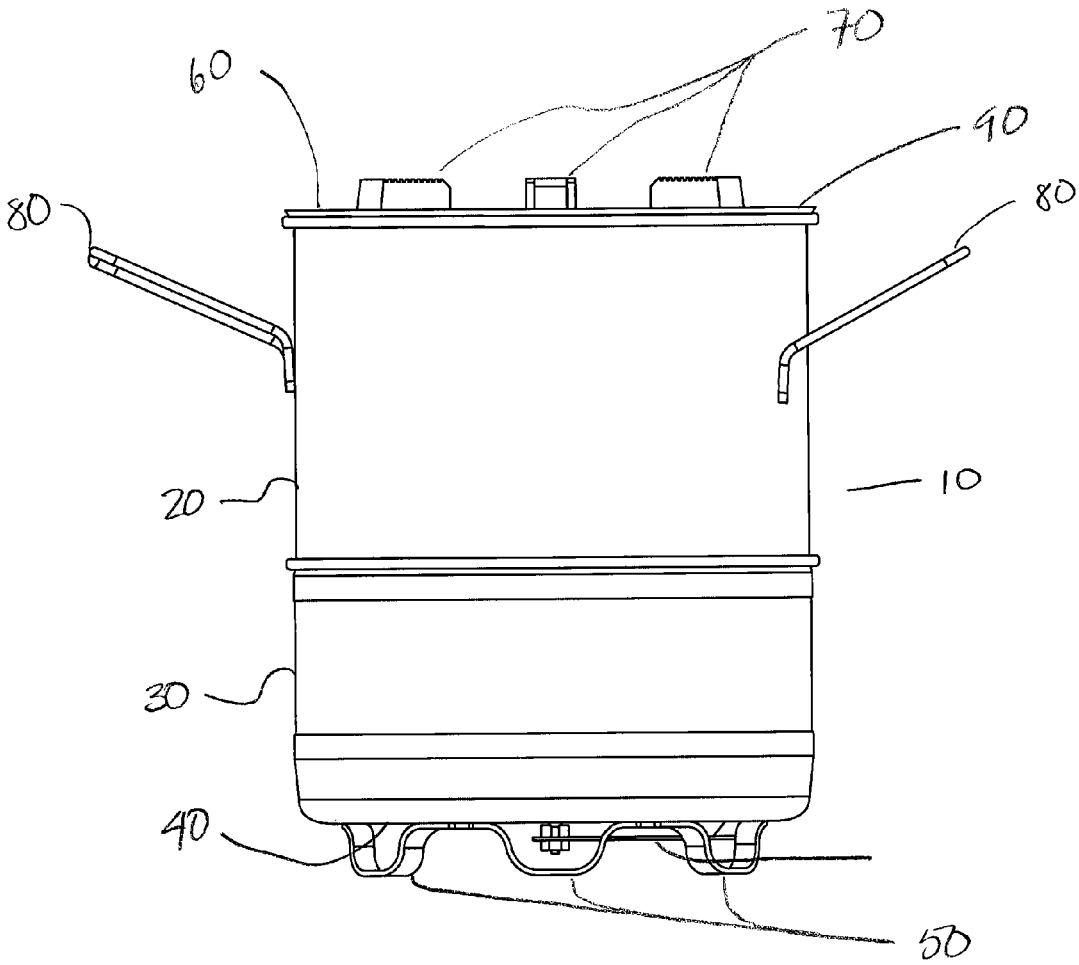
FIG. 2 is a front view of the present stove embodiment.

FIG. 2 shows a front view of a charcoal stove 10 of the currently disclosed invention. The stove 10 is generally constructed of metal to lower the overall weight along with the cost of manufacture and transport. The use of metal may also aid in reducing the thermal mass of the stove. Stoves with greater thermal mass absorb more energy generated by combustion. This absorbed energy raises the temperature of the stove body.

The energy absorbed by high thermal mass stoves might otherwise be used for cooking. Additionally, energy lost to a high thermal mass body might also have been used to enhance combustion. Thus, by reducing the thermal mass of a stove, the stove may be more efficient in both heating a cooking vessel and preventing incomplete combustion.

The stove 10 of the present embodiment may have generally two sections, an upper section 20 and a lower section 30. The lower section 30 of the stove may be generally cylindrical and may define a bottom 40. Legs 50 may be attached to the bottom 40 of the stove 10. The legs 50 may help to raise the stove above a floor, table, or other suitable surface to help protect against the heat of the stove. The legs 50 may also aid in allowing air to flow into the stove as described below.

The top section 20 of the stove may be generally cylindrical and at the top of the stove 10 may be a cooktop 60 which may include pot supports 70. Pot supports 70 may be designed to raise a pot, pan, or other cooking vessel above the cooktop 60 and position the cooking vessel above a combustion chamber outlet (shown in FIG. 3). The upper section 20 may also include handles 80 for transporting the stove 10, or for separating the sections 20, 30. The handles 80 may be attached to the exterior of the upper section as in the present embodiment. In other embodiments, the handles 80 may be integral structures of the upper section 20. In some embodiments there may also be handles 80 associated with the lower section 30.

Figure 3:
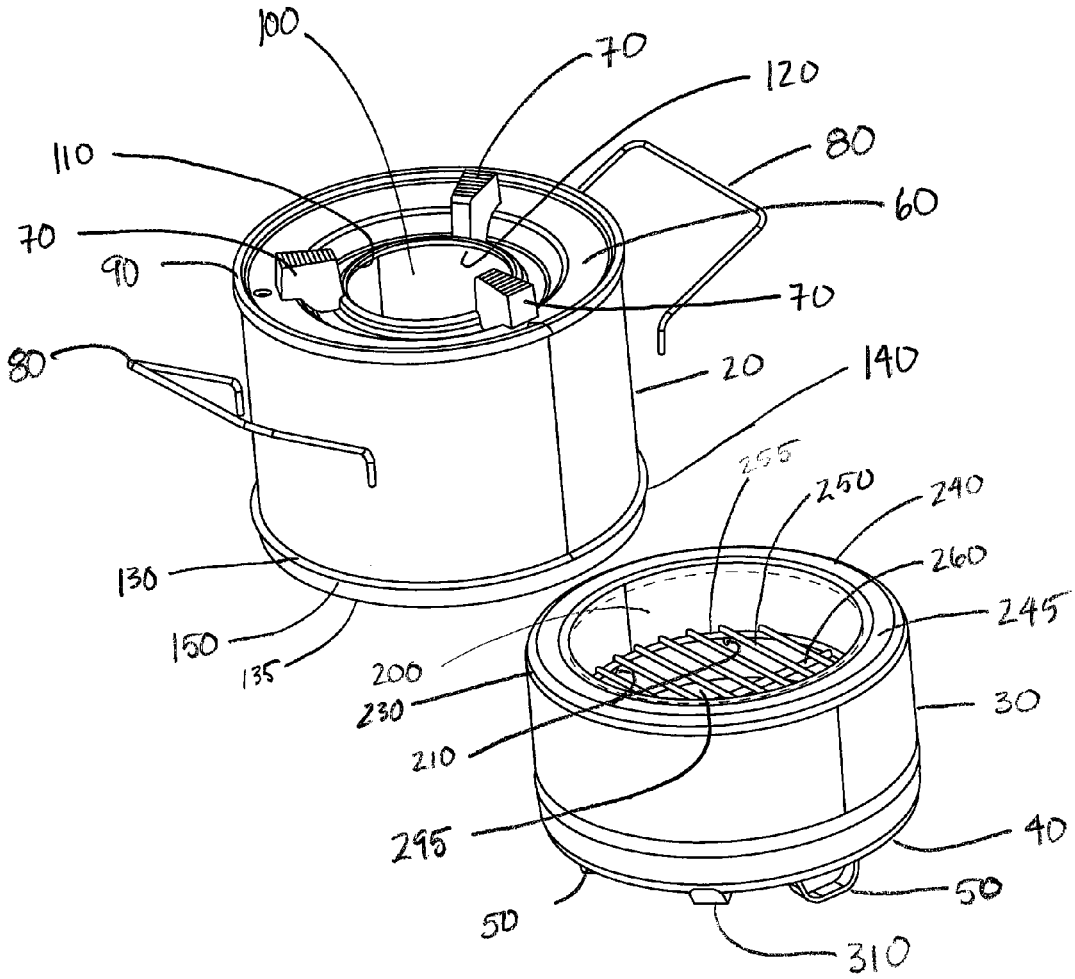
FIG. 3 is an exploded view of the stove of FIG. 2.

FIG. 3 shows the two sections 20, 30 separated from each other. Here, the upper section 20 defines an upper combustion chamber 100. The cooktop 60 defines a combustion chamber outlet 110 generally centered within the cooktop 60. The upper combustion chamber 100 extends generally downward from the combustion chamber outlet 110. The upper combustion chamber 100 is defined by an upper combustion chamber wall 120 that extends downward toward the lower combustion chamber 200. The wall of the upper combustion chamber may be manufactured from a corrosion resistant metal alloy, for example FeCrAl (as described in U.S. Patent Application 61/168,538, which is incorporated in its entirety). In various embodiments the alloy may be comprised of iron, chromium, and aluminum. In various embodiments the alloy may also comprise titanium.

As shown in FIG. 3, separation of the upper 20 and lower sections 30 may aid in allowing access to a lower combustion chamber 200 where fuel 420 may be loaded onto a grate 250. The ability to separate the sections 20, 30 may also aid in removing spent fuel from the lower combustion chamber 200. Separability may also aid in cleaning the stove 10.

The two sections 20, 30 are designed to mate together to form a secure but releasable connection. A ring base 130 is positioned at or near the bottom 140 of the upper section 20. The lower section defines a top 230. The ring base 130 is designed to fit closely over and around a top exterior surface 240 of the lower section 30. At the top 230 of the lower section 30 is a lower connector rim 245. The lower connector rim 245 is convex and designed to closely match the shape of a concave shaped upper connector cap 150 defined by the bottom 140 of the upper section 20. The upper connector cap 150 forms a concave annular ring designed to mate with the convex lower connector rim 245 of the lower section 30. The concave surface of the upper connector cap 150 extends inward from the bottom of the ring base 130 at the exterior of the upper section 20 to a lip structure 135 defined by a funnel structure 400 (shown in FIG. 5A). When the upper connector cap 150 and lower connector rim 245 are mated they may form a barrier to seal the combustion chambers 100, 200 and help prevent the loss of combustion gasses from the combustion chambers 100, 200. The ring base 130 and lip structure 135 help to hold the upper section 20 laterally stable and in place so as to provide a secure connection between the upper 20 and lower sections 30.

The grate 250 may be made from a corrosion resistant wire. In the current embodiment the grate 250 may be made from stainless steel wire, or other suitable materials. This type of wire may help to reduce the thermal mass as compared to traditional ceramic and cast iron materials. A decreased thermal mass may reduce the time and energy required to heat the grate, thus increasing the amount of energy that may be used for cooking, heating the combustion chamber, or combusting uncombusted or partially combusted products. The present stainless steel wire may help to reduce "CO spike" during the startup stage of traditional stoves.

The type of stove design of the present embodiment may be referred to as a batch load stove. In batch load stoves, fuel 420 (shown in FIG. 5B) is added to a lower combustion chamber 200 prior to the start of combustion, after which it may be very difficult, dangerous, or impossible to add additional fuel.

For a batch-loading (single, pre-startup fuel loading) stove, the volume of a fuel bed 410 may substantially determine the maximum amount of fuel 420 that may be consumed per use. Because of this potential constraint, the volume of the fuel bed 410 must be large enough to supply enough fuel 420 for at least the time needed to cook. In various embodiments the fuel bed 410 may be designed to hold enough fuel for about one hour of cooking. In the present embodiment, the maximum volume of the fuel bed 410 may be generally determined by a volume bounded by the grate 250 (on the bottom), the lower combustion chamber wall 220 (to the side), and the top 230 of the lower section 30 of the stove 10. In various other stove embodiments, the maximum fuel bed 420 volume is determined by the volume of the lower combustion chamber above the grate. The amount of fuel 420 that may be loaded into the lower combustion chamber 200 may be substantially less than the maximum volume of the fuel bed 410 in order to provide for adequate air flow through and around the fuel bed 410.

As will be discussed later, the present stove's design and higher efficiency requires less fuel for the same cooking tasks as compared to traditional stoves.

For a constant fuel volume, a taller stove volume allows a narrower fuel region radius, which may be defined by the lower combustion chamber wall 220.

In the embodiment shown in FIG. 3, the grate 250 may be removably attached to the combustion chamber wall 220 above a combustion chamber floor 270. The grate 250 may include an annular ring 255 and a center support 260 that may support a plurality of substantially parallel wires. The annular ring 255 of the grate 250 may be supported by tab structures 210 in the wall 220 of the lower combustion chamber 200. Various embodiments may have variously shaped grates 250 designed to support the fuel 420 and allow adequate airflow around the fuel 420. In various embodiments the grate may include legs for supporting the grate off of a floor 270 of the lower combustion chamber 200.

The grate 250 may aid in combustion of the fuel 420 by allowing air to flow through, under, and around the fuel 420. The lower combustion chamber wall 220 may be made of the corrosion resistant metal alloy. The alloy used in the lower combustion chamber may be similar to that used in the upper combustion chamber. In other embodiments the alloys of the upper and lower combustion chambers may differ, for example in ratios of components, composition, or thickness.

Positioned below the grate 250 may be a lower combustion chamber floor 270, also made of the metal alloy, and a slab 290 (shown in FIG. 4C) positioned substantially off the floor 270. The slab 290 may be covered by a slab cap 295, which may be made of a corrosion resistant alloy.

On the exterior of the stove 10 and positioned at or near the bottom 40 of the lower section 30 may be an air flow regulator handle 310. The regulator handle 310 may aid in controlling the amount of air flowing into the combustion chamber 200.

Figure 4A:
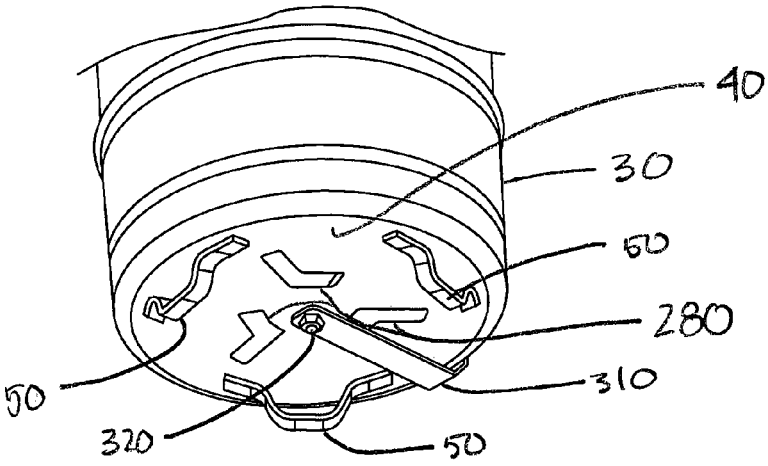
FIG. 4A is a view of the stove of FIG. 2 as seen from a bottom perspective view.
Figure 4B:
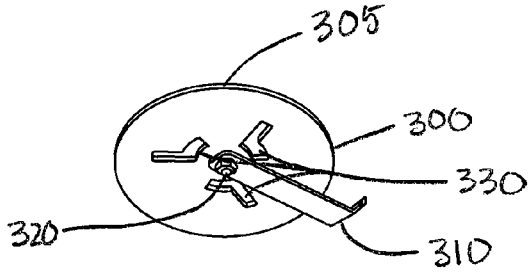
FIG. 4B is a perspective view of the disk regulator and regulator handle.

The air flow regulation of the stove may be more clearly shown in FIGS. 4A and 4B. FIGS. 4A and 4B show views from below the stove. The bottom 40 of the stove 10 defines a plurality of air flow inlets 280. These inlets 280 are designed to be covered by a regulator disk 300 which, as shown in this embodiment, may be positioned in the interior of the lower section 30. In various other embodiments the regulator disk 300 may be positioned at the exterior of the stove 10 such that air flow moves generally through a plurality of disk windows 330 defined by the disk 300 before entering the airflow inlets 280 at the bottom 40 of the stove 10. FIG. 4B shows the regulator disk 300 without the stove.

As can be seen in FIG. 4B, the regulator disk 300 may further define a plurality of windows 330. These windows 330 may correspond in shape to the air flow inlets 280 in the bottom 40 of the stove 10. In various other embodiments the shapes defined by the windows 330 may differ from the shapes defined by the inlets 280.

The disk 300 may be attached to the regulator handle 310 by an axle 320 positioned at or near the center of the bottom 40 of the stove 10. The regulator handle 310 and regulator axle 320 may be secured by nuts such that movement of the disk 300 may be rotatable about the axle 320. The placement of the regulator handle 310 and regulator disk 300 may also help to prevent corrosion from high temperatures and maintain the handle 310 temperature such that it may be used to adjust airflow during cooking.

The design of the regulator disk 300, axle 320, and handle 310 may allow movement of the handle 310 to lead to a rotation of the disk 300. The rotation of the regulator disk 300 about the regulator axle 320 may position the disk windows 330 adjacent to the airflow inlets 280 so that airflow channels the size and shape of the air flow inlets 280 is created in the stove bottom 40 to allow a desired amount of air to flow into the stove interior. The position of regulator disk 300 is adjustable to allow for airflow from a maximum amount to a minimum amount as desired by the user to obtain the desired combustion performance. The regulator disk may be rotated such that the windows 330 and inlets 280 are not adjacent resulting in a minimum of air may flow into the stove interior 340. As will be evident to one of skill in the art, the amount of air flow may be adjusted to this maximum and minimum, and there between as desired for operation of the stove. Moreover, the shape of the disk windows 330 and air flow inlets 280 may be designed to provide for finer control of the air flow at or near the minimum than at the maximum air flow. The regulator disk 300 and/or air inlets 280 may be substantially shielded from the direct line of sight from the combustion chamber outlet 110 by the slab 290 and/or slab cap 295.

Figure 4C:
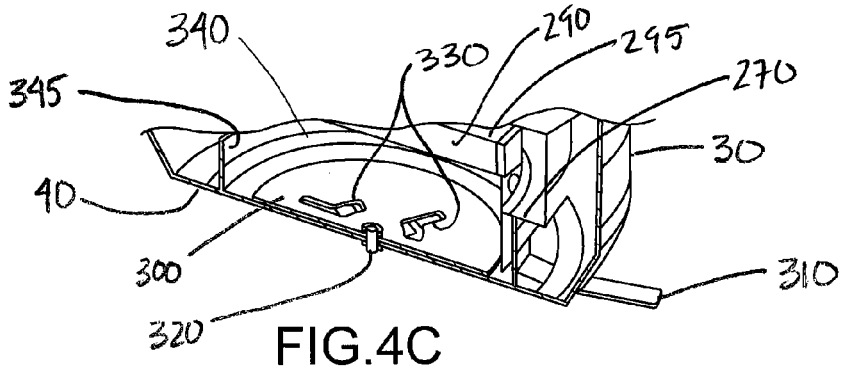
FIG. 4C is a perspective view of the air flow chamber and disk regulator of an alternative stove embodiment.

In various embodiments of the stove 10, the regulator disk windows 330 and the air flow inlets 280 on the stove 10 may be various shapes. For example, as shown in FIG. 4C, without limitation, the windows 330 and/or inlets 280 may be substantially pie shaped. In this embodiment, the windows and inlets may extend only part-way from the axle 320 to a disk edge 305, in still other embodiments the windows 330 and inlets 280 may extend generally from near the axle 320 to near an outer edge 305 of the disk 300. In various other embodiments, the windows 330 and inlets 280 may also be circular, square, or irregularly shaped. While the embodiments depicted in FIG. 4 show the inlets 280 and windows 330 positioned at the bottom 40 of the stove 10, one of skill in the art will appreciate that the present stove design may also have windows 330 and inlets 280 positioned on the side of the stove 10 at or near the bottom 40.

Figure 5A:
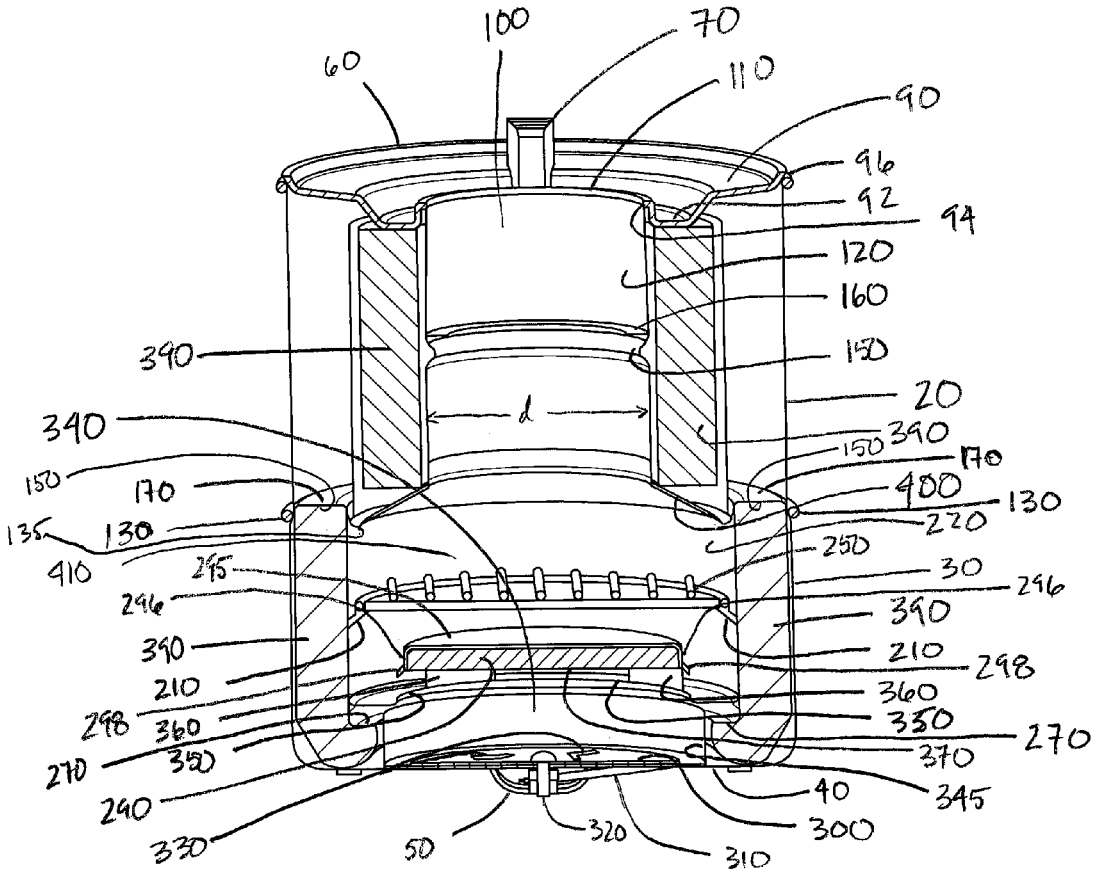

FIG. 5A is a section view of the present stove 10. Starting near the top of the stove, the shape of the cooktop 60 is visible. The cooktop 60 may define a drip pan 90. Positioned about the cooktop 60 may be pot supports 70. The pot supports 70 may be designed to help position a pot or cooking vessel above the combustion chamber outlet 110. The pot supports 70 may further be designed to aid in convective heat transfer to a pot or other cooking vessel by allowing combustion gasses to flow underneath and around the pot or cooking vessel positioned above the combustion chamber outlet 110.

The drip pan 90 may be an annular ring extending around the combustion chamber outlet 110. In various embodiments drip pan 90 may be discontinuously annular. The drip pan 90 may extend from an outer rim 96 of the upper section 20 inward to meet the combustion chamber outlet 110. The drip pan 90 may slope generally downward toward the bottom 40 of the stove 10 and inward toward the combustion chamber outlet 110, then the drip pan 90 may rise sharply upward proximate the combustion chamber outlet 110 to create a drip pan lip 94. The valley created by the drip pan 90 and the drip pan lip 94 may define a drip pan reservoir 92. In various embodiments, the drip pan reservoir 92 may have a flat bottom or a v-shaped bottom. In various other embodiments the reservoir 92 may have a rounded bottom.

The drip pan reservoir 92 may aid in protecting the combustion chambers 100, 200 and fuel bed 410, for example from corrosion or quenching if a pot positioned over the cooktop 60 were to boil over. The position of the reservoir 90 proximate the combustion chamber outlet 110 may help to promote evaporation of liquid from the reservoir 90 before the liquid spills into the combustion chambers 100, 200.

The upper combustion chamber 100 begins below the combustion chamber outlet 110 and proceeds downward toward the lower combustion chamber 200. In the present embodiment the upper combustion chamber 100 is cylindrical with a substantially constant radius. In other embodiments the upper combustion chamber may be slightly funnel shaped with a radius at or near the combustion chamber outlet 110 that differs from the radius near the lower combustion chamber 200. In various other embodiments the upper combustion chamber 100 may define a shape other than a cylinder. For example without limitation the upper combustion chamber 100 may define an oval, a square, a rectangular or other regular or irregular shape.

Within the upper combustion chamber 100 may be a plurality of generally annular constrictions 150, and/or orifice rings/plates 160. The constriction 150 or orifice ring 160 may help to reduce the cross-sectional area of the upper combustion chamber 100. In various embodiments, as depicted here, a constriction 150 may define an annular ridge within the interior of the upper combustion chamber 100 that reduces the interior diameter, d, of the upper combustion chamber 100. The constriction 150 may help to support an orifice ring 160 or orifice plate 160.

While the orifice plate 160 of the current embodiment is positioned near the center of the upper combustion chamber 100, other embodiments may place the orifice ring 160 within the upper third of the upper combustion chamber 100. In some embodiments the orifice ring 160 maybe be positioned at or near the bottom 140 of the upper combustion chamber 100 and spaced above the top of the fuel bed 410. In various embodiments, the orifice ring 160 is attached to the wall 120 of the upper combustion chamber 100 without the need for a constriction, for example, by welding.

Figure 5B:
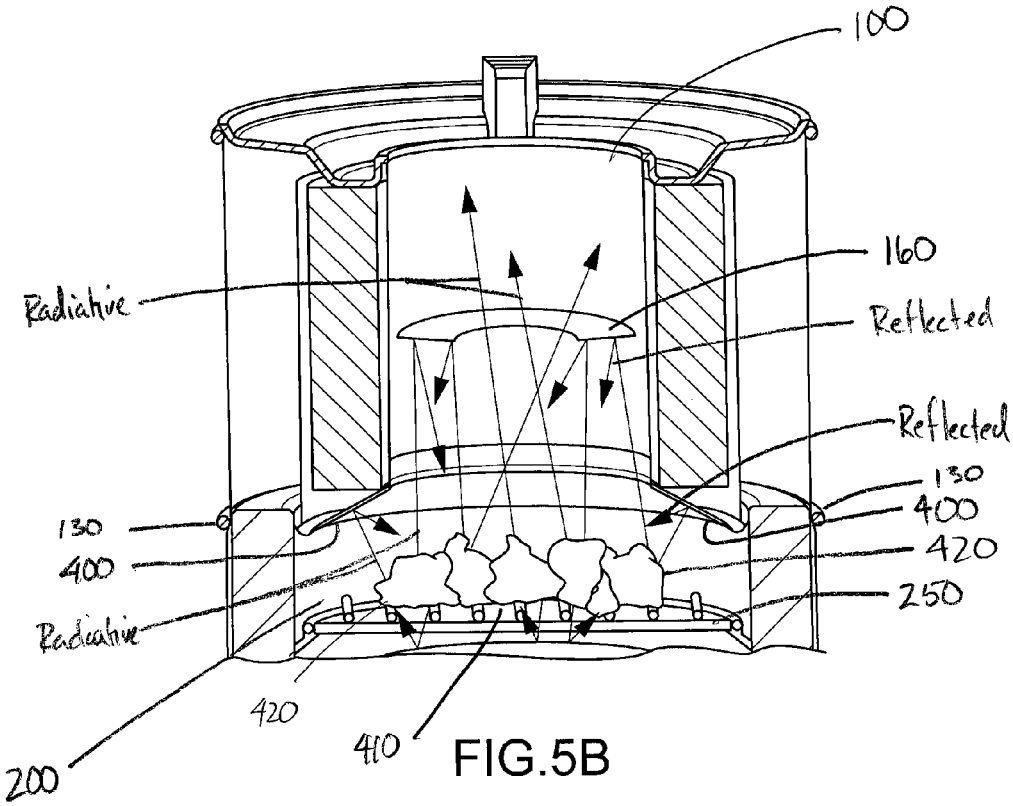
FIG. 5B is an alternative embodiment of the stove of FIG. 5A depicting fuel bed during combustion and radiative energy emitted from the combusting fuel bed.

The orifice plate/ring 160 may serve several functions. For example, the orifice plate 160 may aid in decreasing the view factor. The view factor may be related to the amount of the fuel bed 410 that may be in direct line of sight with the bottom of a cook vessel seated at the cooktop 60. In the embodiment as shown in FIG. 5B, the orifice ring 160 may reduce the view factor by reducing the diameter, d, of the upper combustion chamber 100. The constriction 150 may help to decrease waste heat transfer to the upper chamber walls 120 above the orifice ring 160, and may also help to radiate energy and heat back into the fuel bed 410 thus increasing the combustion temperature and, in turn, the efficiency of combustion. Confining a portion of the energy emitted by the combusting fuel, the temperature of the fuel bed 410 may be increased helping to reduce CO production and oxidize CO that is produced before emission from the stove.

The reduced view factor produced by the constriction 150 may also help keep temperatures at the cooktop 60 reasonable and not so hot that the user experiences difficulty controlling performance. By blocking some of the radiative transfer directed to the underside of the cooking vessel, the temperature of the cooking vessel may be partially moderated.

In some embodiments, the orifice ring 160 may provide increased turbulent intensity and mixing. In various embodiments the orifice ring 160 may also produce an abrupt narrowing in the flow, creating a zone in which a substantial portion of the combustion products are redirected toward a generally hotter center of the upper combustion chamber—this redirection may increase the likelihood that uncombusted material will be combusted.

As seen in FIGS. 5A and 5B, near the bottom 140 of the upper combustion chamber 100 the chamber expands radially outward and downward to meet the lower combustion chamber 200 and form a reverse funnel structure, or combustion funnel 400. The funnel 400 helps to create a transition between the lower and upper combustion chambers 200, 100 and reduces the diameter of the lower combustion chamber 200 to the diameter of the upper combustion chamber 100. The funnel 400 may help direct combustion gases from the lower combustion chamber 200 into the upper combustion chamber 100.

The funnel 400 may be constructed of corrosion resistant alloy, for example FeCrAl. The combustion funnel 400 may be designed to help radiate energy back into the fuel bed 410. The present embodiment of the stove has a cone-shaped combustion funnel 400 with a substantially linear profile providing a transition between the radii of the lower combustion chamber 200 and the upper combustion chamber 100. In other embodiments the funnel 400 may achieve a transition between the two different radii with a curvilinear profile. In still other embodiments there may be no funnel structure 400 to connect the two radii, rather the transition may be a linear and substantially horizontal connection.

The upper combustion chamber 100 of the present stove 10 embodiment may be generally tall and narrow. This shape may help to increase the amount of time gases reside in the combustion chamber and thus increase the likelihood that partially combusted gases will undergo further combustion or oxidation. Additionally, this design aids in maintaining a higher temperature within the combustion chambers 100, 200 and increasing the net radiative heat transfer.

Net radiative heat transfer is a function of the area of a radiating surface and a receiving surface (i.e. the top surface of the fuel bed and the bottom surface of the cooking vessel), the distance between the two surfaces, and the temperatures of the two surfaces. An exemplary equation for the net radiative transfer is shown in FIG. 7, where $Q_{net}$ is heat transfer in Watts, A is area of the surfaces, F is distance between the surfaces, σ (sigma) is the Stefan-boltzman constant, $T_1$ is the temperature of the radiating area or fuel bed surface, and $T_2$ is the temperature of the cooking vessel or pot bottom surface).

Figure 7A:
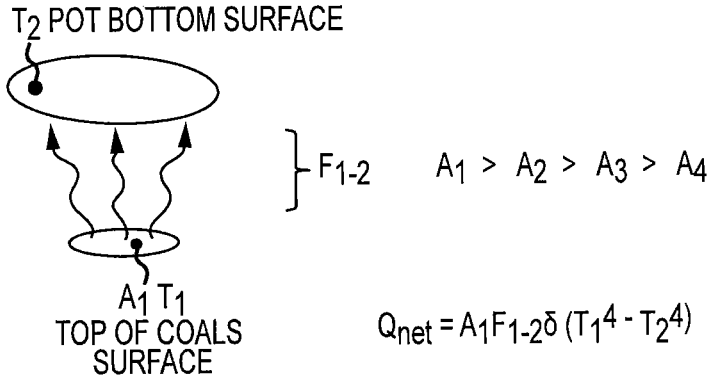
FIG. 7 is a graphic showing the net heat transfer as a function of temperature for stoves of different surface areas.
Figure 7B:
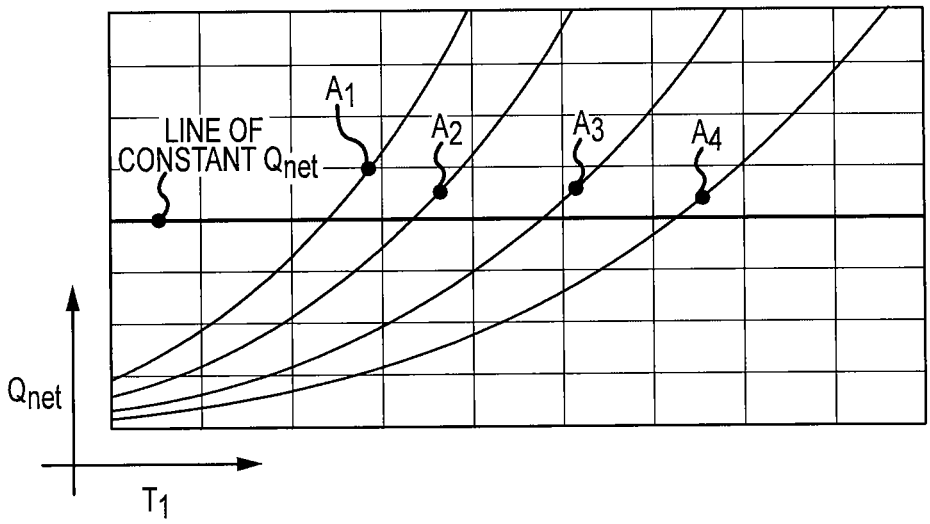

FIG. 7 also provides a graph of the results of this equation for various exposed fuel bed areas. For example, to achieve a relatively constant heat transfer rate from the fuel bed to the cooking vessel, a smaller top layer of fuel bed area must radiate more intensely per unit area. Thus by reducing the area of the fuel bed surface available for heat transfer, a higher temperature is maintained. This higher temperature is the result of the narrowing of the combustion chamber by the reverse funnel and by the narrowing of the upper combustion chamber by the orifice ring. This higher temperature may in turn lead to greater CO destruction or oxidation within the combustion chamber.

For example, if the burn rate and other losses (other than heat transferred to the pot) are relatively constant (or less dependent than temperature raised to the forth power), fuel bed temperature rises until a steady state is reached. Thus, in the stove embodiments shown in FIGS. 1-6, the smaller effective radiation emitting area (which may be due to either the reverse funnel and/or the orifice ring) may lead to higher temperatures of the fuel bed, and the top layer of the fuel bed. These higher temperatures, may in turn, reduce CO production and increase oxidation of CO that is produced.

FIG. 5A also shows the slab 290 positioned above the combustion chamber floor 270. The slab 290 may be supported by a slab plate 370 that is in turn supported by a plurality of slab supports 360 which connect the floor of the combustion chamber 270 to the slab plate 370. The slab supports 360 extend upward from the floor 270 to create a gap between the floor 270 and the slab plate 370. This gap runs discontinuously to define a series of air flow apertures 350. The air flow apertures 350 help to create a passageway for air to flow from an air flow chamber 340 positioned below the slab plate 370 to the lower combustion chamber 200 above. In still other stove embodiments, the apertures 350 may be substantially round and extend around a substantially continuous slab support structure 360 as depicted in FIG. 4C. In other embodiments the apertures 350 may be various other shapes such as squares, rectangles, ovals, etc.

The air flow apertures 350 may be positioned to aid in distributing air flow as evenly as possible below the fuel bed above the grate 250. Additionally the apertures 350 may be positioned to reduce radiative transfer and concomitant heat loss. Here, the apertures 350 may be substantially shielded from the fuel bed's direct line of sight thus preventing escape of radiative heat into the airflow chamber. In other embodiments the apertures may be completely shielded from line of site of any part of the fuel bed supported by the grate.

In FIG. 5, insulation 390 positioned behind the walls 120, 220 of both the upper and lower combustion chambers 100, 200 can also be seen. The insulation 390 may help reduce heat transfer, reduce the stove's thermal mass, and minimize quenching within the combustion chamber 100, 200. The insulation 390 may also help to regulate the temperature of the exterior of the stove 10. Insulation 390 at or near the bottom 40 of the stove 10 may reduce the exterior temperature of the stove so that it may be positioned on a surface without burning or damaging the surface.

In some embodiments, the insulation 390 may be fiberglass based, for example, Fiberfrax. Various stove embodiments may use vermiculite, perlite, or other suitable natural or synthetic insulating materials. The insulation 390 behind the chamber walls 120, 220 may be made from the same materials or may differ. The slab 290 may also be made from insulation material 390 similar to the insulation 390 material behind the walls, or it may be of a different material.

The slab 290 and slab cap 295 may help to further insulate the lower combustion chamber 200 and radiate heat back to the fuel bed. The slab cap 295 may further define a skirt 296 that extends downward to substantially surround the slab 290. At the base of the skirt 296 may be a flange 298. The flange 298 may be designed to help shield apertures 350 positioned below from the line of sight of the fuel bed.

In use, air is pulled into the stove 10 from beneath the bottom 40 and into the air flow inlets 280. The amount of air flowing through the air flow inlets 280 may be regulated by movement of the regulator handle 310 which in turn may reduce or increase the size of the air flow passage defined by the airflow inlets 280 and disk windows 330 up to a maximum wherein the area of the air flow inlets 280 is unobstructed by the regulator disk 300 (i.e. where the disk windows 330 are substantially similar in size and shape, or larger than, the inlets 280 and may be positioned on the regulator disk 300 to correspond to the positions of the airflow inlets 280). Air continues to flow through the inlets 280, past the disk windows 330 and into the air flow chamber 340. From the air flow chamber 340 the air enters the lower combustion chamber 200 through the air flow apertures 350 defined by the combustion chamber floor 270, the slab supports 360, and the slab plate 370.

The upper section 20 may define a length or height of the upper combustion chamber 100. This length may help increase average residency times for combustion products within the upper combustion chamber 100. Thus, rather than exiting the stove 10 in proximity to their creation (near the fuel bed), combustion products may travel through extra layers of the combustion region. The length of the upper combustion chamber 100 may also help to increase flow through the fuel bed and lower combustion chamber 200 by enhancement of the stack or chimney effect. The stack effect may refer to the drawing of air through the stove. This effect may be related to the buoyancy of and density difference of air and gases within the stove. Buoyancy may be affected by both the temperature of the gases (hot combustion gases have lower density) and the height of the stove. That is, the strength of the stack effect increases with chimney height and air/gas temperature difference.

In one aspect of the current charcoal combustion chamber design, inflow of combustion air may be controlled, and the inflow of air may be indirectly shielded from the charcoal/fuel bed to prevent loss of radiative heat through airflow apertures 350. In another aspect of the current design, the amount of radiative heat directed toward a pot is reduced and may be partially reflected back to the charcoal/fuel bed to enhance or maintain the temperature of the charcoal bed.

Figure 6:
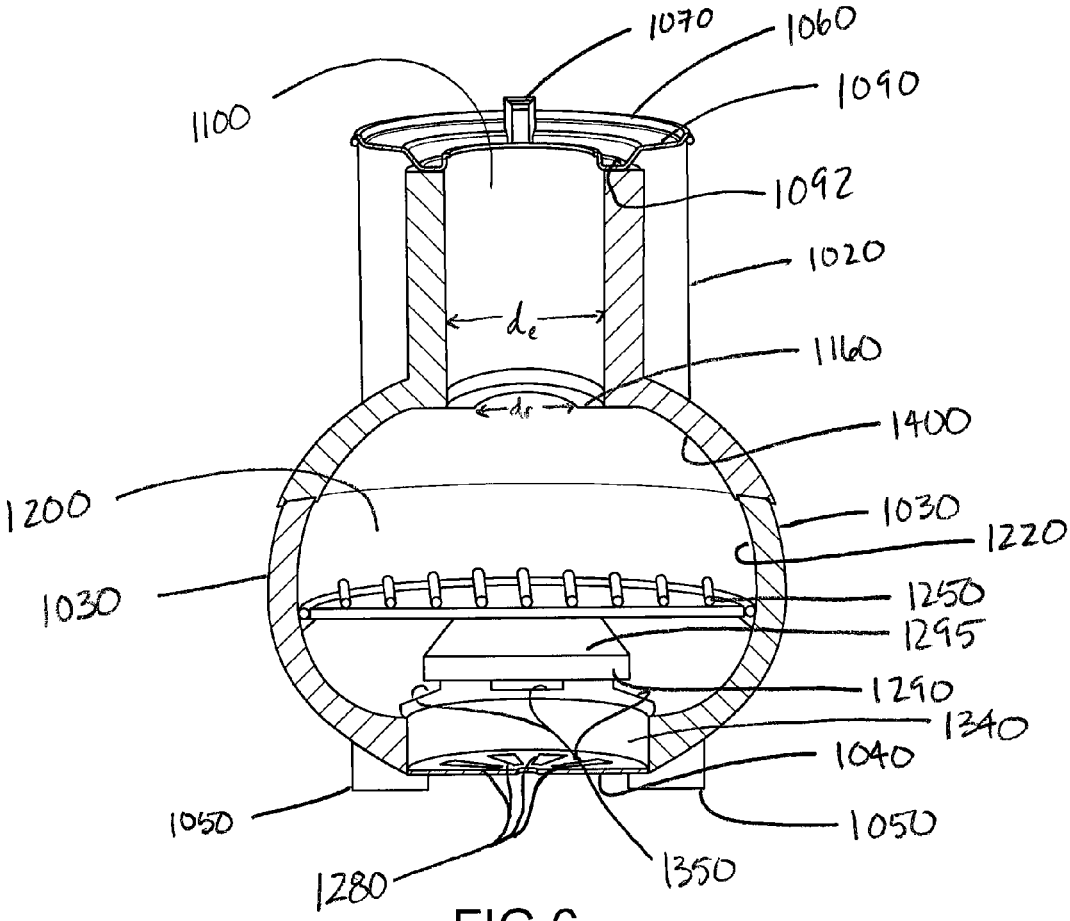
FIG. 6 is a front section view in the same plane as FIG. 5 showing an alternative stove embodiment.

FIG. 6 shows an alternative embodiment of the present stove. The embodiment in FIG. 6 has a funnel structure 1400 that may be curvilinear rather than a straight line. In addition, rather than having a separate orifice plate structure, the constriction 1160 at the base of the upper combustion chamber 1100 is formed from the wall of the funnel 1400. This constriction may serve a similar function as an orifice ring in that it defines a smaller inner radius $d_r$ than the radius $d_c$ of the upper combustion chamber 1100. The embodiment shown in FIG. 6 depicts an orifice ring 1160 with an internal radius smaller than the radius of the upper combustion chamber 1100, however various embodiments of the stove as presently described and claimed include a constriction that may be substantially equal to the radius of the upper combustion chamber.

Example 1

Fuel Bed Temperature

The present stove embodiment has been compared to the KCJ stove. To measure the temperature bed of the stoves, a thermocouple was placed within the coal beds of the stove during operation. The present embodiment stove may offer an addition 10% increase in thermal efficiency over the KCJ stove. The present embodiment charcoal stove burns at much higher temperatures than the KCJ stove. For example, the top of charcoal fuel bed of the present stove reaches temperatures estimated at greater than 1100° K [~830° C.], while the KCJ stove's fuel bed reaches temperatures of about 900-1000° K [~630-~730° C.]. The present charcoal stove shows about a 10% increase in burn rate and approximately double the airflow rate.

Example 2

CO Emission and Thermal Efficiency

The presently embodied charcoal stove shows a reduction in CO emission. Stove emissions were measured using testing protocols described in DeFoort, M. D., L'Orange, C., Kreutzer, C., Lorenz, N., Kamping, W, and Alders, J., *Stove Manufacturers Emissions & Performance Test Protocol* (*EPTP*). See Appendix A. Briefly, The EPTP takes approximately 1.5-2 hours and consists of three phases performed three times in sequence with modifications for charcoal stoves. Phase 1, the cold-start (CS) test, is a high-power test wherein the tester begins with the stove at room temperature and uses a pre-weighed bundle of wood or other fuel to heat a measured quantity of water to 90° C. in a standard pot. Phase 2, the hot-start (HS) high-power test, immediately follows the first test, and is performed while the stove is still hot. In the hot-start, the tester first replaces water heated in phase 1 with a fresh pot of cold water at the established starting temperature. Again using a pre-weighed bundle of fuel, the tester heats the water to 90° C. in a standard pot. Repeating the heating test with a hot stove helps to identify performance differences when a stove is hot versus cold. Phase 3, the simmer test, continues immediately from the second phase. Here, the tester determines the amount of fuel required to simmer a measured amount of water at just above 90° C. for 45 minutes. This step simulates the long cooking of legumes or pulses common throughout much of the world.

Table I shows results from a EPTP test. In this test, the Jiko stove emitted nearly 62 grams of CO, while the presently embodied stove emitted less than 14 grams from and used less fuel during the test. Furthermore, in a cold start test, the KCJ stove produces about 30 grams of carbon monoxide, while the present stove emitted only 5 g.

TABLE I

| | EPTP Charcoal Use (g) | EPTP CO (g) | EPTP Thermal Efficiency (%) | Time to Boil (min) |
|---|---|---|---|---|
| Ceramic Jiko | 273.5 ± 24.3 | 61.5 ± 16.0 | 27.9 ± 3.9 | 37.2 ± 0.4 |
| Present Stove | 237.8 ± 5.6 | 13.9 ± 2.0 | 30.9 ± 0.8 | 37.5 ± 2.6 |

Figure 8A:
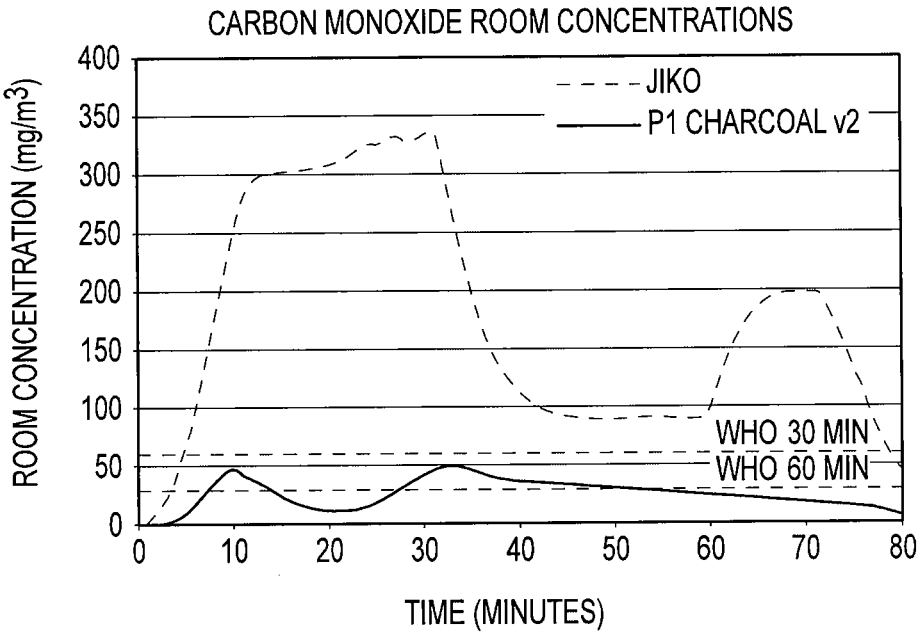
FIG. 8A is a graphical comparison of CO production from the current stove and the Jiko Stove.
Figure 8B:
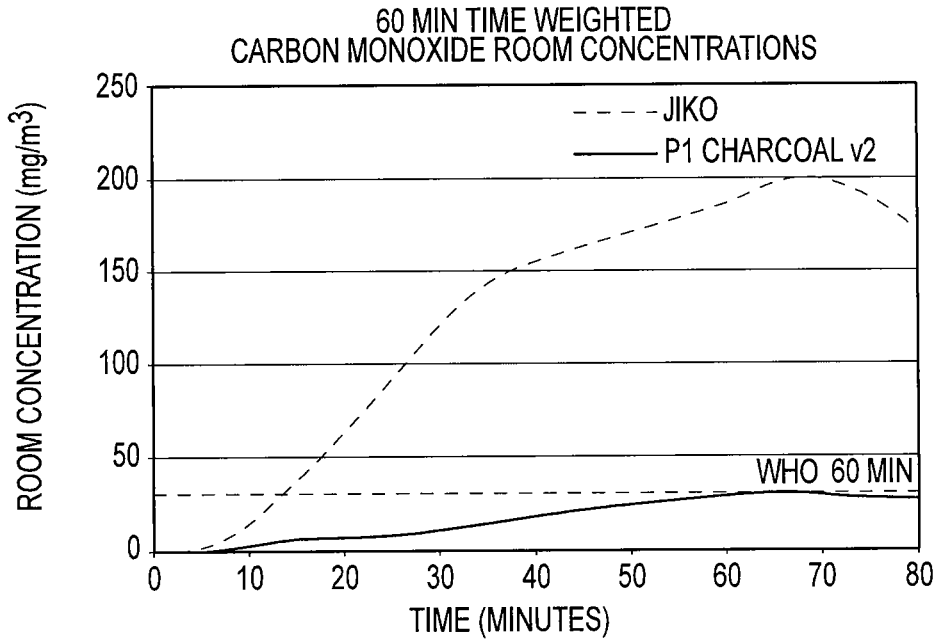
FIG. 8B is a graphical comparison of CO production from the current stove and the Jiko Stove over a 60 minute period.

FIGS. 8A and 8B show the results from EPTP tests on the Jiko stove and the present charcoal stove embodiment. In FIG. 8A the results are graphed as carbon monoxide concentrations as a function of time. FIG. 8B depicts the data of FIG. 8A as a CO concentration over 60 minutes.

Example 3

Chemical Kinetics Modeling of CO Oxidation

Compared to the KCJ stove, the present stove embodiment runs at higher temperatures, has increased oxygen flow, and longer residency times. Stove flow rates may be measured by standard measurements of oxygen and carbon balance.

The higher burn rate has an obvious effect on time to boil. Assuming similar thermal efficiencies, the higher burn rate supplies more energy to heat the pot. Increasing temperature is also the most direct way to increase both radiative and convective heat transfer rates to the pot. Convective transfer is also helped by the increased airflow in the present stove embodiment.

All directional references (e.g., upper, lower, upward, downward, left, right, leftward, rightward, top, bottom, above, below, inner, outer, vertical, horizontal, clockwise, and counterclockwise) are only used for identification purposes to aid the reader's understanding of the example of the invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

It will be apparent to those of ordinary skill in the art that variations and alternative embodiments may be made given the foregoing description. Such variations and alternative embodiments are accordingly considered within the scope of the present invention.

What is claimed is:

1. A biomass combustion chamber comprising;

an upper combustion chamber;

a lower combustion chamber, wherein the lower combustion chamber includes a grate for supporting a fuel bed, said fuel bed for accepting a solid fuel, a plurality of air flow apertures for allowing oxygen into the combustion chamber, wherein the apertures are substantially shielded from the direct line of site of the fuel bed, and the cross-section of the upper combustion chamber is less than the cross section of the lower combustion chamber; and a slab and a slab cap, wherein the slab cap further comprises a lip and flange for aiding in shielding the apertures from direct view of fuel positioned in the fuel bed, wherein the upper combustion chamber and lower combustion chambers are separably engaged at a respective lower rim and upper rim; and the upper combustion chamber further defining a cone shaped funnel structure in direct line of site of the fuel bed.

2. The combustion chamber of claim 1, the funnel structure for mating the cross-sections of the upper and lower combustion chambers.

3. The combustion chamber of claim 1, wherein the funnel structure is substantially linear.

4. The combustion chamber of claim 3, wherein the funnel structure is contiguous with the upper combustion chamber.

5. The combustion chamber of claim 3, wherein the funnel structure is contiguous with the lower combustion chamber.

6. The combustion chamber of claim 1, wherein the funnel structure is substantially curvi-linear.

7. The combustion chamber of claim 1, wherein the funnel structure aids in redirecting radiant heat back to the fuel bed.

8. The combustion chamber of claim 1, wherein the lower combustion chamber is round.

9. The combustion chamber of claim 1, further comprising an orifice ring positioned in the upper combustion chamber.

10. The combustion chamber of claim 9, wherein the orifice ring is positioned within the bottom one-third of the upper combustion chamber.

11. The combustion chamber of claim 9, wherein the combustion chamber walls and orifice ring are made of a corrosion resistant alloy metal.

12. The combustion chamber of claim 9, wherein the orifice ring is a structure independent of the upper combustion chamber wall.

13. The combustion chamber of claim 9, wherein the orifice ring is a constriction in the upper combustion chamber wall.

14. The combustion chamber of claim 1, wherein the combustion chamber walls are made of a corrosion resistant alloy metal.

15. A biomass stove comprising;

an upper section defining an outer wall and an inner wall separated by at least one cavity, the inner wall defining an upper combustion chamber, a lower rim positioned at the bottom of the first inner wall and bottom of the outer wall, wherein a funnel structure positioned at or near the bottom of the inner wall, wherein the bottom of the funnel structure defines a cross-sectional dimension that is larger than a cross-sectional dimension defined by the top of the funnel structure;

an orifice ring positioned within and in contact with the inner wall of the upper combustion chamber, wherein the orifice ring has an inner diameter and an outer diameter, the inner diameter being smaller than the diameter of the upper combustion chamber;

a lower section defining an outer wall and an inner wall separated by at least one cavity, the inner wall defining a lower combustion chamber;

an upper rim positioned at the top of the first inner wall and top of the outer wall, wherein the upper and lower sections are separably engaged at said respective upper rim and lower rim, the lower combustion chamber for receiving fuel, and a plurality of air flow apertures, wherein the apertures are substantially shielded from the direct line of site of a fuel bed positioned on a grate; and the upper combustion chamber further defines a funnel structure in direct line of site of the fuel bed.

16. The biomass stove of claim 15, wherein insulation is positioned within the cavity of the upper section, within the cavity of the lower combustion chamber, or within both cavities.

* * * * *